US012789103B1

(12) United States Patent
Duffey et al.

(10) Patent No.: US 12,789,103 B1
(45) Date of Patent: Nov. 10, 2026

(54) PORTABLE AND COLLAPSIBLE SWING SET WITH SUN SHADE

(71) Applicants: Skyler Duffey, Fruita, CO (US); Deborah Tuttle, Fruita, CO (US)

(72) Inventors: Skyler Duffey, Fruita, CO (US); Deborah Tuttle, Fruita, CO (US)

( * ) Notice: Subject to any disclaimer, the term of this patent is extended or adjusted under 35 U.S.C. 154(b) by 318 days.

(21) Appl. No.: 18/544,740

(22) Filed: Dec. 19, 2023

(51) Int. Cl.
*A63G 9/02* (2006.01)
*E04H 15/00* (2006.01)
*E04H 15/48* (2006.01)

(52) U.S. Cl.
CPC ..... *A63G 9/02* (2013.01); *E04H 15/008* (2013.01); *E04H 15/48* (2013.01)

(58) Field of Classification Search
CPC ..... A63G 9/02; E04H 15/008; E04H 15/48
See application file for complete search history.

(56) References Cited

U.S. PATENT DOCUMENTS 539,723 A * 5/1895 Caisse ..... A63G 9/02 297/157.1
3,990,667 A * 11/1976 Tomalinas, Jr. ..... A47D 13/105 248/370
6,019,427 A * 2/2000 Combest ..... B60P 3/36 297/277
6,958,017 B1 * 10/2005 Toombs, Jr. ..... A63G 9/00 472/125

FOREIGN PATENT DOCUMENTS

CN 101032667 A * 9/2007

* cited by examiner

*Primary Examiner* — Amr A Awad

(74) *Attorney, Agent, or Firm* — Gugliotta & Gugliotta LPA

(57) ABSTRACT

A portable and collapsible swing set device is provided designed with children in mind, including a frame and a sun shade. The frame supports a swing via various hanging means and features four adjustable and foldable legs connected to a top bar with eyelets for swing attachment. The legs incorporate shock absorbers for added stability and safety. The sun shade, made of sunlight-resistant textile, attaches to the frame and is designed for easy folding and storage. The device can be compactly stored in a specially designed storage bag, facilitating effortless transportation and quick setup and addresses the need for flexible, child-friendly recreational play equipment in locations where permanent swing sets are impractical.

15 Claims, 4 Drawing Sheets

PORTABLE AND COLLAPSIBLE SWING SET WITH SUN SHADE

RELATED APPLICATIONS

There are no previously filed, nor currently any co-pending applications, anywhere in the world.

BACKGROUND OF THE INVENTION

1. Field of the Invention

The present invention relates generally to outdoor play equipment and, more particularly, to a portable, collapsible swing set device designed for children, incorporating a sun shade for protection against elements.

2. Description of the Related Art

Playing on a backyard swing set offers a multitude of benefits for children's physical, cognitive, and emotional development. First and foremost, swinging helps improve balance, coordination, and gross motor skills as children pump their legs and use their arms to maintain momentum. The repetitive motion of swinging also stimulates the vestibular system, enhancing spatial awareness and sensory integration. Additionally, swinging provides a sense of freedom and exhilaration, promoting a healthy dose of adrenaline and endorphin release, which can contribute to improved mood and overall well-being.

Finally, playing on a swing set encourages imaginative play, social interaction, and cooperative skills as children engage in role-playing, take turns, and negotiate rules with their peers. However, many play locations do not offer swing sets, such as rental properties, vacation homes, grandparents' homes, and the like. It is typically not cost effective to build a swing set at each location. Additionally, large swing sets are often too big for young children and infants.

While swing sets play a crucial role in children's development but are often absent in temporary living spaces or outdoor events due to their permanent and cumbersome nature. Traditional swing sets are not practical for transient or rental properties, vacation homes, or outdoor gatherings, creating a gap in children's recreational activities in these settings.

Accordingly, there exists a need for a means by which a swing sets can be utilized on an as-needed but temporary basis.

SUMMARY OF THE INVENTION

It is thus an object of the present invention to addresses this gap by introducing a portable and collapsible swing set frame with an integrated sun shade.

It is a feature of the present invention to provide a swing frame and a sun shade designed for quick assembly and disassembly, making it ideal for various temporary locations. The frame supports a swing via hanging means like straps or chains, while the sun shade offers protection from sun and inclement weather. These features combine strength and versatility, providing a safe and durable platform for endless outdoor play.

The present invention caters to children of different ages and sizes, ensuring an optimal swinging experience for all. It is perfect for travel, vacations, camping, family member homes, or anywhere without a conventional swing set. It can easily be packed in a car or even checked on an airplane, and the use of the present invention provides swinging enjoyment for young children in a manner which is quick, easy, and effective, no matter the location.

Further features of the invention will become apparent in the course of the following description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | | | |
|---|---|---|---|
| 10 | swing set frame device | 40 | leg |
| 15 | frame | 45 | folding device |
| 20 | sun shade | 50 | leg folding travel path "a" |
| 25 | swing | 55 | leg extension travel path "b" |
| 30 | hanging means | 60 | locking mechanism |
| 35 | top bar | 65 | eyelet |
| 70 | stabilizing brace | 120 | center ridge rod |
| 75 | shock absorber | 125 | folding hanging rod |
| 80 | outer frame | 130 | hanging flap |
| 85 | pivot point | 135 | vertical stanchion |
| 90 | partially deployed position | 140 | clamp |
| 95 | fully deployed position | 145 | storage bag |
| 100 | pin spring | 150 | drawstring |
| 105 | actuation lever | 155 | shoulder strap |
| 110 | pin hole | 160 | insertion travel path "i" |
| 115 | textile | | |

DESCRIPTION OF THE PREFERRED EMBODIMENTS

The best mode for carrying out the invention is presented in terms of its preferred embodiment, herein depicted within FIG. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

1. DETAILED DESCRIPTION OF THE FIGURES

Figure 1:
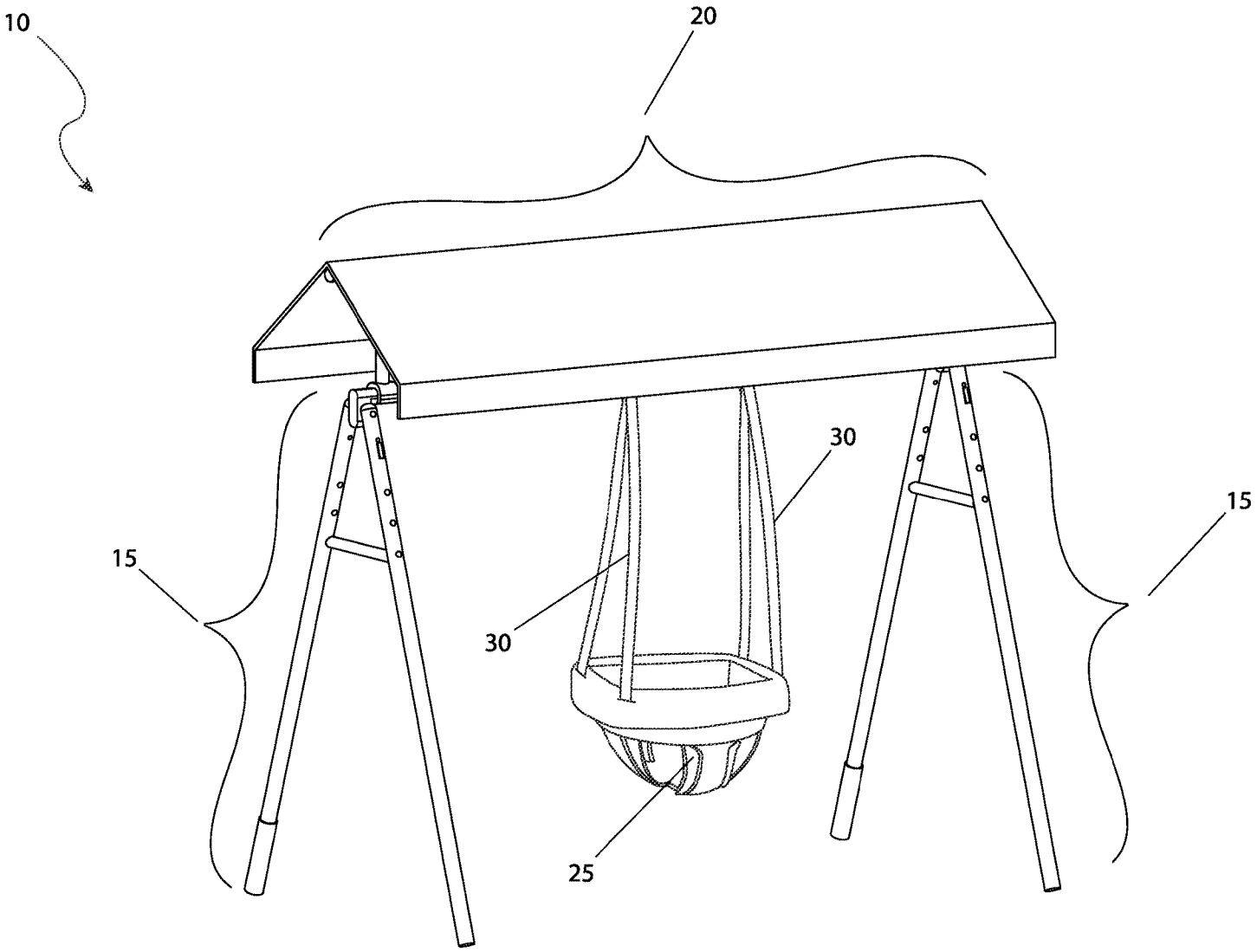
FIG. 1 is a perspective view of the swing set frame device 10, according to the preferred embodiment of the present invention.

Referring now to FIG. 1, a perspective view of a portable and collapsible swing set frame device 10, according to the preferred embodiment of the present invention is disclosed. The swing set frame device (herein also described as the "device") 10, comprises a portable and collapsible support device that functions as swing set frame 15. The device 10 includes two (2) major components, a frame 15 and a sun shade 20, which will be described in detail herein below. The frame 15 is used to support a swing 25 by two (2) or more hanging means 30 such as straps, chains, ropes or the like. It is envisioned that the swing 25 would be generic in nature and can take many different forms. The swing 25 may or may not be provided as an integral component of the device 10. As such, a typical swing 25 is shown for illustrative purposes only. The sun shade 20 is attached to the top of the frame 15 to provided protection for the occupant of the swing 25 from sun or other inclement weather conditions. It is envisioned that the device 10 as shown would be used in locations where a permanent swing is impractical or not cost effective. Such locations are envisioned as rental properties, vacation homes, grandparents' homes, outdoor concerts, parks, sporting events, and the like. The device 10 is easily dissembled and collapsed, allowing for easy storage and transport as will be described herein below.

Figure 2:
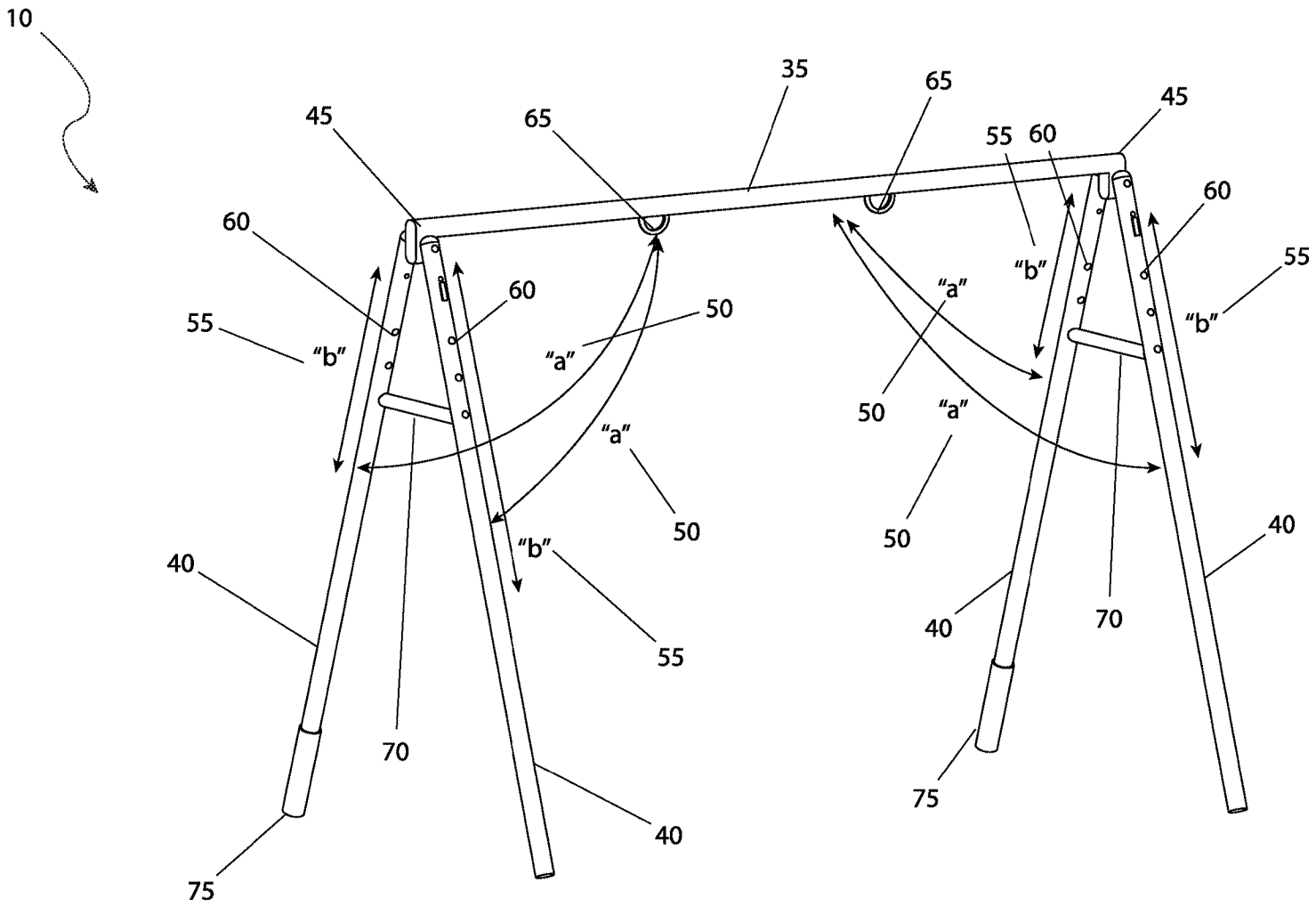
FIG. 2 is a perspective view of the frame 15, as used with the swing set frame device 10, according to the preferred embodiment of the present invention.

Referring next to FIG. 2, a perspective view of the frame 15, as used with the device 10, according to the preferred embodiment of the present invention is depicted. The frame 15 includes a top bar 35 supported by four (4) legs 40 (two (2) per side). Each pair of legs 40 are connected to the top bar 35 by a folding device 45 (or knuckle). The top bar 35 is envisioned to be thirty-six inches (36 in.) long. Further information on the folding device 45 will be provided herein below. When not in use, each legs 40 folds up against the top bar 35 along a leg folding travel path "a" 50. Additionally, each legs 40 is extendable in length along a leg extension travel path "b" 55 using a locking mechanism 60, such as a spring pin and hole as shown. Other types of locking mechanism 60 such as lock cam, friction fit, and the like may also be utilized. As such, the exact type of locking mechanism 60 as used with the device 10 shall not be interpreted as a limiting factor of the present invention. It is envisioned that each leg 40 is extendable from thirty-six inches (36 in.) to forty-eight inches (48 in.).

The top bar 35 is provided with two (2) eyelets 65 which are used to connect to the hanging means 30 (as shown in FIG. 1) using "S"-hooks, carbineers, or other suitable fasteners, without the need for tools. Each pair of legs 40 may or may not be provided with a stabilizing brace 70 for additional structural integrity. The rear two (2) legs 40 are provided with a shock absorber 75 on the bottom to absorb directional impact as the swing 25 moves back and forth. Such action is also envisioned to increase the stabilization of the device 10 and prevent capsizing.

Figure 3:
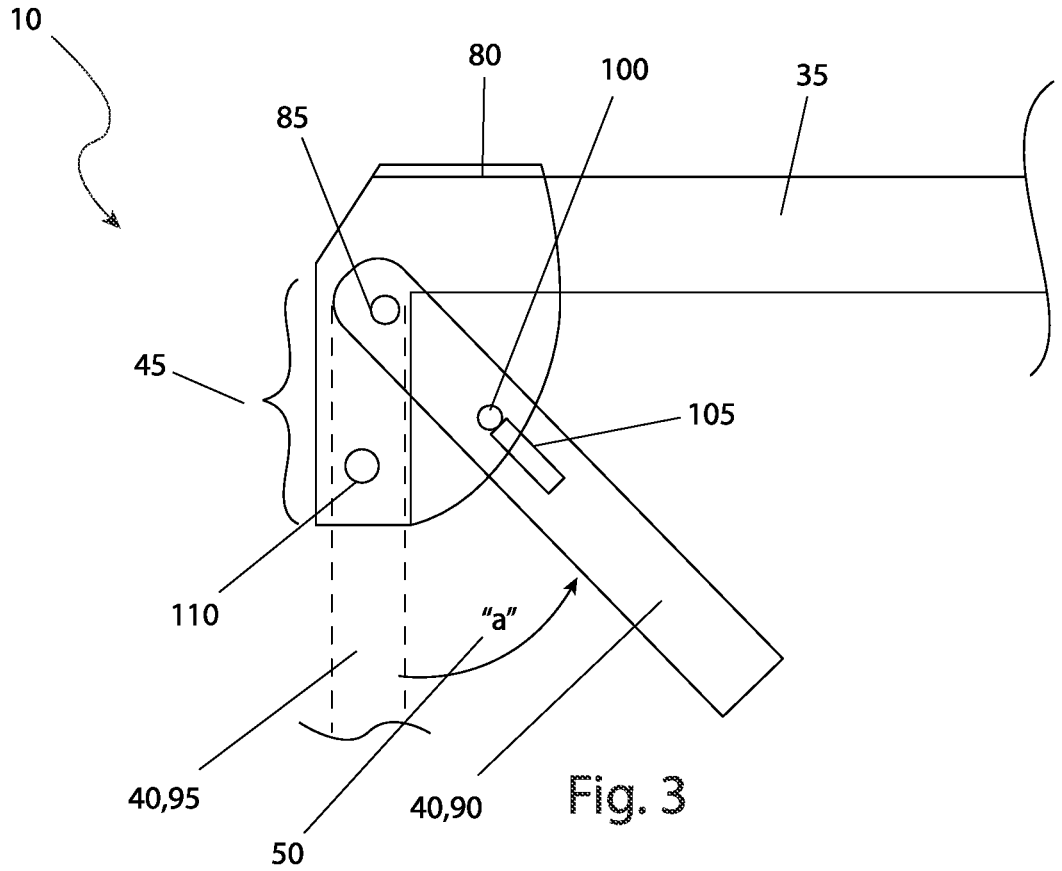
FIG. 3 is a detailed side view of the locking mechanism 60, as used on the swing set frame device 10, according to the preferred embodiment of the present invention.

Referring now to FIG. 3, a detailed side view of the locking mechanism 60, as used on the device 10, according to the preferred embodiment of the present invention is shown. It is noted that only one (1) of the two (2) folding devices 45 is shown in FIG. 3, with the remaining folding device 45 being a mirror image of the one (1) shown. The folding device 45 is provided with an outer frame 80 which encompasses the top bar 35 and the legs 40. The legs 40 are attached at a pivot point 85 which allows movement of the legs 40 from a partially deployed position 90 to a fully deployed position 95 along the leg folding travel path "a" 50. This movement is accomplished via use of a pin spring 100, which is actuated by an actuation lever 105, which allows placement of the pin spring 100 into a pin hole 110 to place and lock the leg s 40 in the fully deployed position 95. When the device 10 is to be stored away, the pin spring 100 is pressed, the legs 40 are fully moved along the leg folding travel path "a" 50 for subsequent storage as will be described in greater detail herein below.

Figure 4:
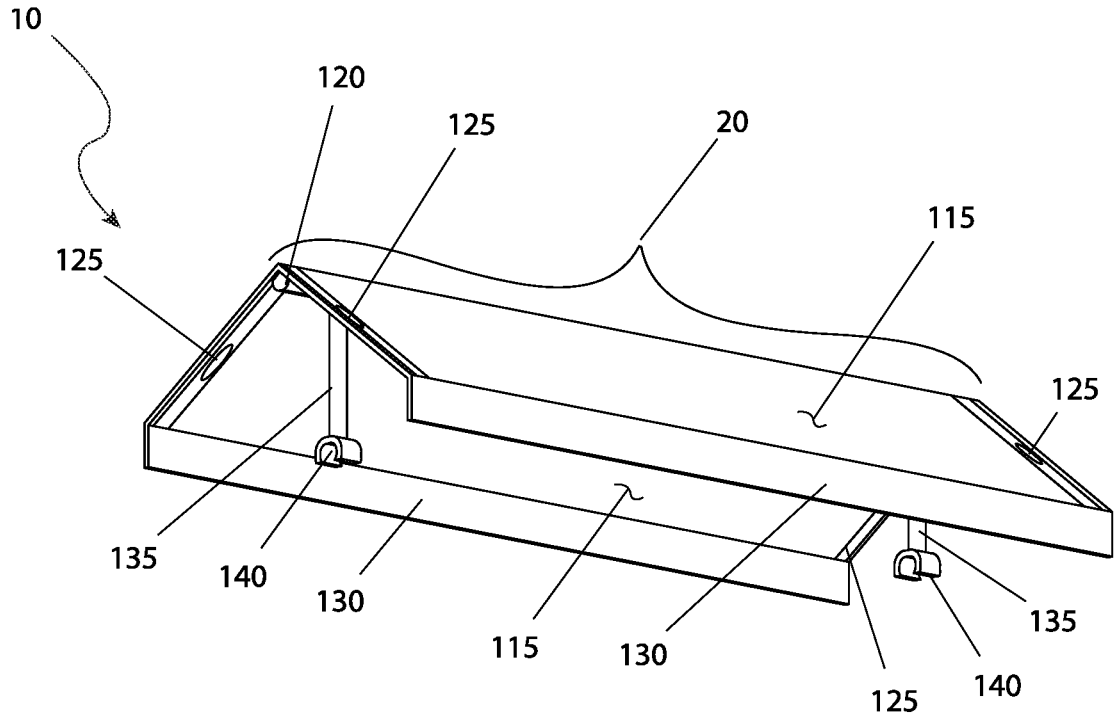
FIG. 4 is a perspective view of the sun shade 20, as used with the swing set frame device 10, according to the preferred embodiment of the present invention; and, FIG. 5 is a perspective view of the swing set frame device 10, as it is being stored in storage bag 145, according to the preferred embodiment of the present invention.

Referring next to FIG. 4, a perspective view of the sun shade 20, as used with the device 10, according to the preferred embodiment of the present invention is disclosed. The sun shade 20 utilizes textile 115 that is flexible and resistant to sunlight such as canvas, nylon, woven reinforced polyethylene fabrics, or the like. The textile 115 is supported by a center ridge rod 120 along with four (4) folding hanging rods 125. Each folding hanging rod 125 allows for a bi-folding action which provides for capsizing of the sun shade 20 for subsequent storage and transport as will be described below. The textile 115 provides for two (2) hanging flaps 130 to further its sun-block ability. The center ridge rod 120 is supported by two (2) vertical stanchions 135, each of which have a clamp 140 on its lower end. The clamp 140 attach to the top bar 35 (as shown in FIG. 2) by friction fit and can be applied and removed without the use of tools.

Figure 5:
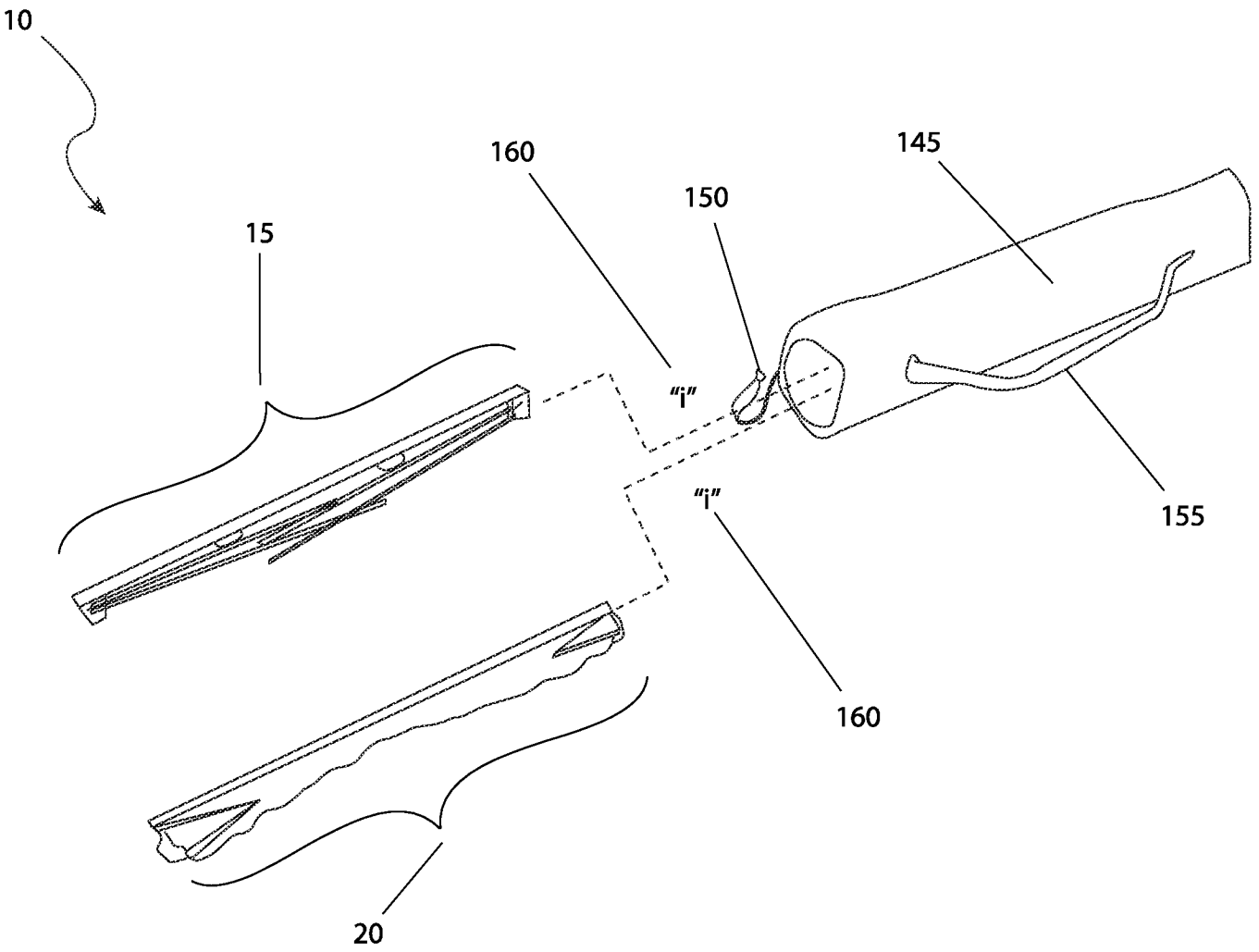

Referring to FIG. 5, a perspective view of the device 10, as it is being stored in storage bag 145, according to the preferred embodiment of the present invention is depicted. The storage bag 145 is provided complete with a drawstring 150 for closure and a shoulder strap 155 for ease of transport. The storage bag 145 would be similar in nature to a storage bag commonly used to carry folding camping chairs. With the frame 15 in its folded state, and the sun shade 20 in its folded state, they are both placed into the open end of the storage bag 145 along an insertion travel path "i" 160, in a typical and customary manner.

2. OPERATION OF THE PREFERRED EMBODIMENT

The preferred embodiment of the present invention can be utilized by the common user in a simple and effortless manner with little or no training. It is envisioned that the device 10 would be constructed in general accordance with FIG. 1 through FIG. 5. The user would procure the device 10 from conventional procurement channels such as discount stores, department stores, baby supply retailers, mail order and internet supply houses and the like.

After procurement and prior to utilization, the frame 15 and the sun shade 20 would be removed from the storage bag 145, each of the four (4) legs 40 would be unfolded from the top bar 35 and locked into a fully deployed position 95 using the pin spring 100 and pin hole 110, the swing 25 would be attached to the eyelets 65 with the aid of the hanging means 30, the sun shade 20 would be unfolded along the folding hanging rods 125, and the sun shade 20 attached to the top bar 35 of the frame 15 using the clamp 140 on the end of the vertical stanchions 135. At this point in time, the device 10 is ready for use. During utilization, the device 10 would be utilized as a standard swing structure and used in the typical manner. The device 10 would cater to children of different ages and sizes, ensuring an optimal swinging experience for all. When not be used, the device 10 folds compactly and is easily stored out of the way. The storage bag 145 ensures that the device 10 can be easily transported to and from different utilization locations. As such, the device 10 is perfect for travel, vacations, camping, family member homes, or anywhere without a conventional swing set. The device 10 may be packed in a car or even checked on an airplane.

After use, the device 10 may be left in an assembled position with the swing 25 attached for later use on a short-term manner. If not needed during a longer term, the device 10 may be disabled following a reverse procedure as described above and stored in the storage bag 145 for future use at the same or different location in a repeating and cyclical manner.

The foregoing descriptions of specific embodiments of the present invention are presented for purposes of illustration and description. The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but is to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way. Any unintended embracement of such subject matter is hereby disclaimed. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as are suited to the particular use contemplated. It is intended that a scope of the invention be defined broadly by the Drawings and Specification appended hereto and to their equivalents. Therefore, the scope of the invention is in no way to be limited only by any adverse inference under the rulings of Warner-Jenkinson Company, v. Hilton Davis Chemical, 520 US 17 (1997) or Festo Corp. v. Shoketsu Kinzoku Kogyo Kabushiki Co., 535 U.S. 722 (2002), or other similar caselaw or subsequent precedent should not be made if any future claims are added or amended subsequent to this Patent Application.

What is claimed is:

1. A portable and collapsible swing set device comprising a frame with adjustable and foldable legs, a sun shade, and means for attaching a swing, wherein the legs are foldable against the frame and lockably adjustable in length via a spring-pin locking mechanism, a sun shade comprising a center ridge rod, folding hanging rods, and sunlight-resistant textile, the sun shade being attachable to the frame via clamps and collapsible for storage, and means for attaching a swing, wherein the device is sized and configured for compact storage in a portable storage bag and transportation to temporary locations.

2. The device of claim 1, wherein the frame includes a top bar with eyelets for swing attachment and rear leg shock absorbers mounted at the base of the rear legs for stability, wherein the shock absorbers are configured to absorb directional impact as the swing moves back and forth and prevent capsizing of the device.

3. The device of claim 1, wherein the sun shade is made from sunlight-resistant textile and includes a folding mechanism comprising a center ridge rod supported by two vertical stanchions with clamps and a plurality of folding hanging rods that permit bi-folding of the sun shade for compact storage, the folding mechanism allowing the sun shade to be attached to and removed from the top bar of the frame without tools.

4. The device of claim 2, wherein the sun shade is made from sunlight-resistant textile and includes a folding mechanism comprising a center ridge rod supported by two vertical stanchions with clamps and a plurality of folding hanging rods that permit bi-folding of the sun shade for compact storage, the folding mechanism allowing the sun shade to be attached to and removed from the top bar of the frame without tools.

5. A device of claim 1 further comprising:

a frame with four adjustable and foldable legs, wherein each leg is foldable against the top bar along a leg folding travel path and extendable in length along a leg extension travel path;

a top bar connected to said legs, featuring eyelets for swing attachment;

shock absorbers located at the base of the rear legs for stability, configured to absorb directional impact and prevent capsizing; and a sun shade made of sunlight-resistant textile, attachable to the top bar via clamps on vertical stanchions without the use of tools, and collapsible via folding hanging rods for compact storage.

6. The device of claim 5, wherein each leg includes a locking mechanism for adjusting the length of the legs.

7. The device of claim 5, wherein the sun shade comprises a center ridge rod and folding hanging rods for collapsible action.

8. The device of claim 6, wherein the sun shade comprises a center ridge rod and folding hanging rods for collapsible action.

9. The device of claim 5, wherein the frame and sun shade are constructed of materials suitable for outdoor use and resistant to weather elements.

10. The device of claim 6, wherein the frame and sun shade are constructed of materials suitable for outdoor use and resistant to weather elements.

11. The device of claim 7, wherein the frame and sun shade are constructed of materials suitable for outdoor use and resistant to weather elements.

12. A kit for a portable and collapsible swing set, comprising:

components for assembling the frame as described in claim 4;

components for assembling the sun shade as described in claim 4; and a storage bag comprising a flexible bag body, a drawstring closure, and a shoulder strap, for transporting the disassembled swing set and sun shade to and from various temporary locations.

13. The kit of claim 12, further including a swing attachable to the frame via the eyelets.

14. The kit of claim 12, wherein the storage bag includes a drawstring closure and a shoulder strap for ease of transportation.

15. The device of claim 13, wherein the frame and sun shade are constructed of materials suitable for outdoor use and resistant to weather elements.

* * * * *